US007370558B1

(12) United States Patent
Chenelia

(10) Patent No.: US 7,370,558 B1
(45) Date of Patent: May 13, 2008

(54) WRISTWATCH BUCKLE BOTTLE CAP OPENER SYSTEM

(76) Inventor: Dominic A. Chenelia, 2151 W. California St., San Diego, CA (US) 92110

( * ) Notice: Subject to any disclaimer, the term of this patent is extended or adjusted under 35 U.S.C. 154(b) by 0 days.

(21) Appl. No.: 11/732,420

(22) Filed: Apr. 3, 2007

(51) Int. Cl.
*B67B 7/16* (2006.01)

(52) U.S. Cl. ..... 81/3.4; 81/3.55; 81/3.57

(58) Field of Classification Search ..... 81/3.4, 81/3.57, 3.55; D8/33, 34, 38, 18; 24/71 J
See application file for complete search history.

(56) References Cited

U.S. PATENT DOCUMENTS

D183,727 S * 10/1958 Emberton ..... D8/34
5,261,299 A * 11/1993 Kondos ..... 81/3.57
6,098,497 A * 8/2000 Larose ..... 81/3.4
6,185,772 B1 * 2/2001 Bates ..... 81/3.55
6,761,088 B1 * 7/2004 Sasso ..... 81/3.57
6,786,113 B2 * 9/2004 Brailsford et al. ..... 81/3.55
2007/0163393 A1 * 7/2007 Ondeck et al. ..... 81/3.57

* cited by examiner

*Primary Examiner*—Hadi Shakeri
(74) *Attorney, Agent, or Firm*—Gordon & Rees, LLP

(57) ABSTRACT

A bottle opening wristwatch band, including: a pivot member; a buckle loop rotatably connected to the pivot member; a buckle clasp rotatably connected to the pivot member, the buckle clasp having a protrusion thereon, the protrusion being dimensioned to be received under an edge of a bottle cap; and a rotation stop positioned to limit rotation of the buckle clasp with respect to the buckle loop.

10 Claims, 2 Drawing Sheets

WRISTWATCH BUCKLE BOTTLE CAP OPENER SYSTEM

TECHNICAL FIELD

The present invention is a wristwatch buckle designed to open bottle caps.

BACKGROUND OF THE INVENTION

Bottle cap openers are notoriously easy to lose, and are often misplaced in the kitchen. This is especially true of small bottle cap openers.

Sometimes, bottle cap openers are attached to key chains. Such bottle cap openers are typically used as advertising, with various corporate or sports team's logos prominently displayed thereon. These sorts of bottle cap openers often tend to be bulky and gaudy, especially when dangling or rattling on a user's key chain.

It is therefore instead desired to provide a bottle cap opener that is easy to find, and easy to use. It is also desired that such a bottle cap opener be discrete, and can be carried around by a user without drawing attention to the user.

SUMMARY OF THE INVENTION

The present invention provides a bottle opening wristwatch band, comprising: a pivot member; a buckle loop rotatably connected to the pivot member; a buckle clasp rotatably connected to the pivot member, the buckle clasp having a protrusion thereon, the protrusion being dimensioned to be received under an edge of a bottle cap; and a rotation stop positioned to limit rotation of the buckle clasp with respect to the buckle loop.

In different embodiments, the rotation stop may be positioned on the buckle loop, or on the pivot member. In operation, the buckle clasp is rotated away from the buckle loop to a position at which the rotation stop prevents any more movement. At this position, a bottle cap may be placed between the buckle clasp and loop. The end of the buckle loop will be sitting on the bottle cap and the end of the buckle clasp will be sitting just under the edge of the bottle cap. Optionally, a protrusion on the buckle clasp extends around an edge of the buckle clasp opposite to the pivot member. The user then rotates the loop and clasp together, and pops off the bottle cap.

In preferred embodiments, the rotation stop limits rotation of the buckle loop with respect to the buckle clasp to less than 40 or 60 degrees.

DETAILED DESCRIPTION OF THE DRAWINGS

Figure 1:
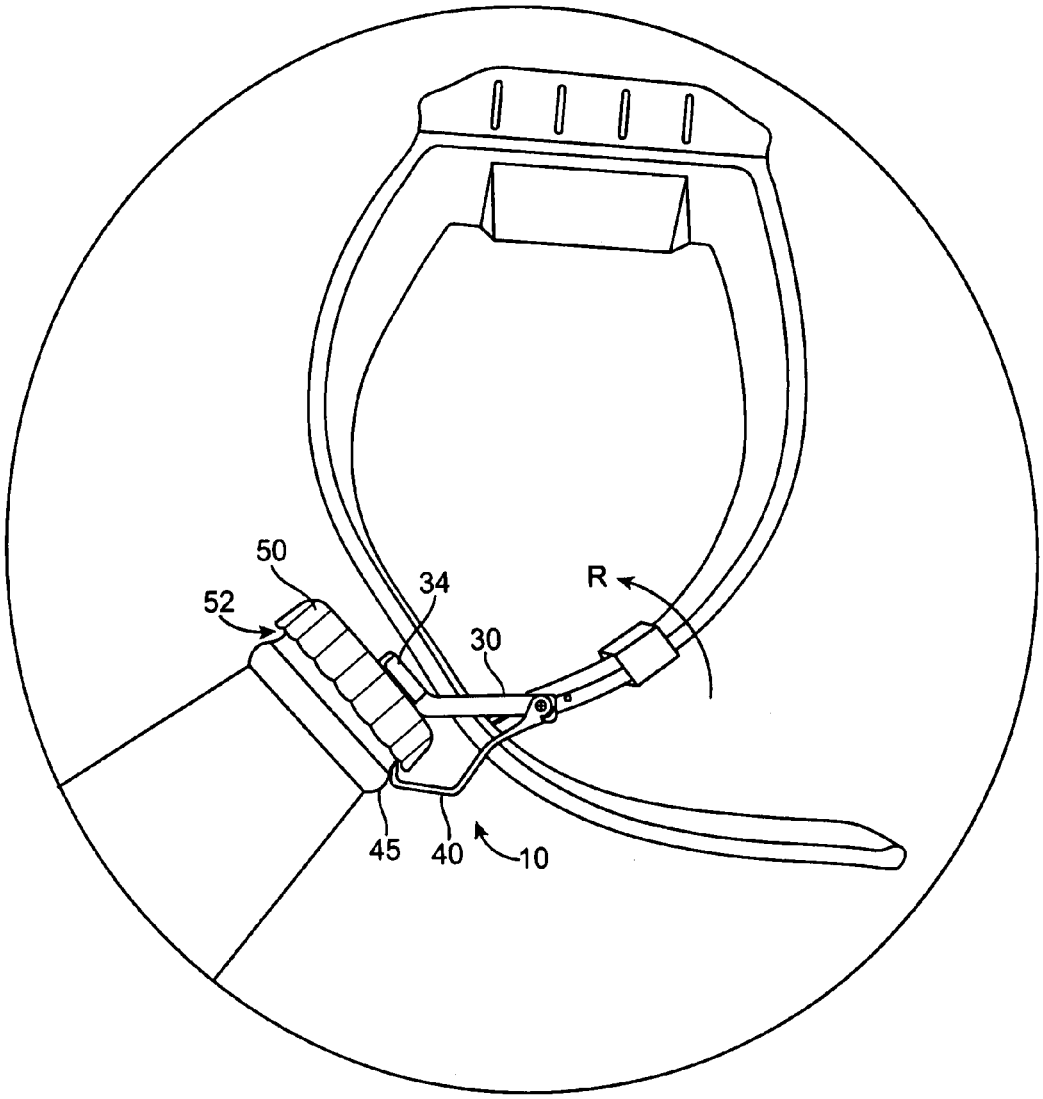
FIG. 1 is an illustration of the present system in operation.
Figure 2:
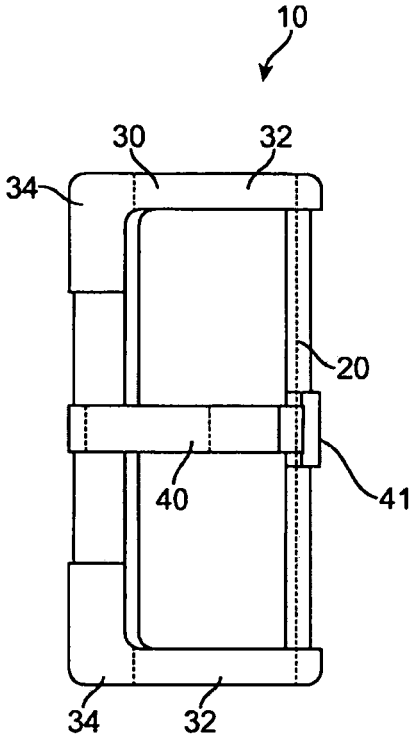
FIG. 2 is a top plan view of the buckle loop and buckle clasp mounted onto the pivot member of the present system.

Operation of the present invention is seen in FIGS. 1 to 3B as follows.

System 10 includes a pivot member 20 with a buckle loop 30 rotatably connected thereto. A buckle clasp 40 is also rotatably connected to pivot member 20. Buckle clasp 40 optionally has a protrusion 45 thereon, with protrusion 45 being dimensioned to be received under an edge 52 of a bottle cap 50.

A rotation stop 41 is positioned to limit rotation of buckle clasp 40 with respect to buckle loop 30. As illustrated, rotation stop 41 may be positioned on buckle loop 30. Alternatively, rotation stop 41 may instead be positioned on pivot member 20, all keeping within the scope of the present invention.

In optional embodiments, rotation stop 41 may limit rotation of buckle loop 30 with respect to buckle clasp 40 to less than 40, or less than 60 degrees.

Figure 3A:
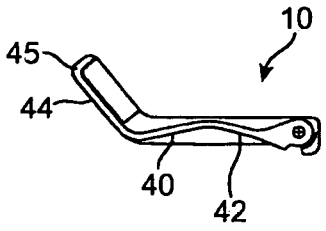
FIG. 3A is a sectional side view of the buckle loop and buckle clasp in a first position (when the bottle opener is not in use).

As can be seen, optional protrusion 45 on buckle clasp 40 may extend around an edge of buckle clasp 30 opposite to pivot member 20 (as seen in FIG. 3A).

Figure 3B:
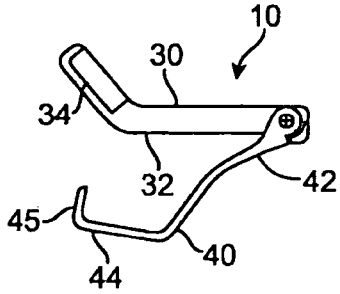
FIG. 3B is a sectional side view of the buckle loop and buckle clasp in a second position (when the bottle opener is in use).

As can also be seen, buckle loop 30 may comprise a first portion 32 and a second portion 34, with second portion 34 being disposed at an angle to the first portion (as seen in FIGS. 3A and 3B). Preferably, second portion 34 is dimensioned to sit flat upon a bottle cap (as seen in FIG. 1). As also seen, buckle clasp 40 preferably comprises a first portion 42 and a second portion 44, wherein second portion 44 is disposed at an angle to first portion 42.

When the present system is not in use, i.e.: when the user is simply wearing his/her watch, the buckle loop 30 and clasp 40 are in the "closed" position as shown in FIG. 3A.

When the system is in use, i.e.: when the user is removing a bottle cap, the buckle loop 30 and clasp 40 are in the "open" position as shown in FIG. 3B. Specifically, rotation stop 41 will only allow buckle loop 30 and clasp 40 to be opened to the degree shown in FIG. 3B. No further opening of the "jaws" formed by buckle loop 30 and clasp 40 will be possible.

Next, the user will position the bottle cap as shown in FIG. 1 such that protrusion 45 on buckle clasp 40 is received under edge 52 of bottle cap 50 while the second portion 44 of buckle clasp 44 rests on top of bottle cap 50. The user simply rotates the device in direction R with respect to bottle cap 50 (as shown in FIG. 1), and bottle cap 50 "pops off" of the bottle.

What is claimed is:

1. A bottle opening wristwatch band, comprising:

a pivot member;

a buckle loop rotatably connected to the pivot member;

a buckle clasp rotatably connected to the pivot member, the buckle clasp having a protrusion thereon, the protrusion being dimensioned to be received under an edge of a bottle cap; and a rotation stop positioned to limit rotation of the buckle clasp with respect to the buckle loop, wherein the rotation stop limits rotation of the buckle loop with respect to the buckle clasp to less than 60 degrees.

2. The band of claim 1, wherein the rotation stop is positioned on the buckle loop.

3. The band system of claim 1, wherein the rotation stop limits rotation of the buckle loop with respect to the buckle clasp to less than 40 degrees.

4. The band of claim 1, wherein the protrusion on the buckle clasp extends around an edge of the buckle clasp opposite to the pivot member.

5. The band of claim 1, wherein the buckle loop comprises a first portion and a second portion, and wherein the second portion is disposed at an angle to the first portion.

6. The band of claim 5, wherein the second portion is dimensioned to sit flat upon a bottle cap.

7. The band of claim 6, wherein the buckle clasp comprises a first portion and a second portion, and wherein the second portion is disposed at an angle to the first portion.

8. The band of claim 7, wherein the second portion of the buckle clasp is rotated into contact against the second portion of the buckle loop when the system is not in use.

9. The band of claim 7, wherein the second portion of the buckle clasp is rotated away from the second portion of the buckle loop when the system is in use.

10. The band of claim 1, wherein the buckle loop and buckle clasp are dimensioned such that the protrusion on the buckle clasp can be received under a bottle cap while the buckle clasp rests on top of the bottle cap.

* * * * *